US006301453B1

(12) United States Patent
Tsutsumi

(10) Patent No.: US 6,301,453 B1
(45) Date of Patent: Oct. 9, 2001

(54) DEVELOPING UNIT USING OSCILLATORY BIAS VOLTAGE

(75) Inventor: Yasuyuki Tsutsumi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/520,790

(22) Filed: Mar. 8, 2000

(30) Foreign Application Priority Data

Jun. 23, 1999 (JP) ..... 11-177436

(51) Int. Cl.[7] ..... G03G 15/06
(52) U.S. Cl. ..... 399/55; 399/285
(58) Field of Search ..... 399/270, 285, 399/266, 55, 234, 235

(56) References Cited

U.S. PATENT DOCUMENTS 4,653,426 * 3/1987 Kohyama ..... 399/285
5,534,982 * 7/1996 Sakaizawa et al. ..... 399/270
5,600,415 * 2/1997 Takahashi ..... 399/55
5,860,040 * 1/1999 Shimizu et al. ..... 399/55
5,911,098 * 6/1999 Gyotoku et al. ..... 399/264
5,999,782 * 12/1999 Iguchi et al. ..... 399/270

FOREIGN PATENT DOCUMENTS 56-014266 * 2/1981 (JP) .
56-101169 * 8/1981 (JP) .
57-147668 * 9/1982 (JP) .
2-130569 5/1990 (JP) .
4-35074 6/1992 (JP) .

* cited by examiner

*Primary Examiner*—Robert Beatty
(74) *Attorney, Agent, or Firm*—Oliff & Berridge, PLC.

(57) ABSTRACT

The invention provides a developing unit, and an image forming apparatus using the same, which is capable of suppressing developer in the middle of a developing process in a developing area from remaining on the surface of an electrostatic latent image carrier when the application of oscillatory bias voltage applied to the developer carrier is stopped and of preventing the inside of the image forming apparatus and each member such as transfer member from being contaminated by the developer. The frequency of the oscillatory bias voltage is controlled so as to be higher than a normal frequency when stopping the application of the oscillating bias voltage.

10 Claims, 10 Drawing Sheets

DEVELOPING UNIT USING OSCILLATORY BIAS VOLTAGE

BACKGROUND OF THE INVENTION

1. Field of the Invention:

The present invention relates to a developing unit for use in an image forming apparatus such as a printer, a copier and a facsimile to which an electrophotographic process, an electrostatic recording process or the like is applied and to the image forming apparatus using the same or more specifically to a developing unit for developing an electrostatic latent image formed on an electrostatic latent image carrier by applying oscillatory bias voltage to the developer carrier and to an image forming apparatus using the same.

2. Description of the Related Art:

Hitherto a technology of applying oscillatory bias voltage to a developer carrier has been widely used for a developing unit for developing an electrostatic latent image in an image forming apparatus such as a printer, a copier and a facsimile to which an electrophotographic process or an electrostatic recording process is applied.

Such developing unit is constructed so as to create an oscillating electric field between the developer carrier and the electrostatic latent image carrier by applying the oscillatory bias voltage to the developer carrier and to fly the developer reciproactively between the developer carrier and the electrostatic latent image carrier by the oscillatory electric field to improve the developing efficiency and to prevent fogging and the like.

Then, the image forming apparatus to which the developing unit described above is applied is arranged so as to fly the developer reciproactively between the developer carrier and the electrostatic latent image carrier by applying the oscillatory bias voltage in which DC voltage is superimposed to AC voltage to the developer carrier during the image forming operation to improve the developing efficiency and to prevent fogging and to stop the application of the oscillatory bias voltage to the developer carrier when the image forming operation ends However, the prior art technology described above has has the following problems. That is, in the image forming apparatus to which the conventional developing unit is applied, the developer in the middle of the developing process in the developing area remains on the surface of the electrostatic latent image carrier regardless whether there is any electrostatic latent image or not when the application of the oscillatory bias voltage which has been oscillated for the development is stopped as the image forming operation end. More specifically, when the application of the oscillatory bias voltage is stopped, the developer which has adhered on the surface of the electrostatic latent image carrier remains while adhering on the surface of the electrostatic latent image carrier regardless whether there is any electrostatic latent image or not by Van der Waals force and image force because no force for pulling back the developer to the side of the developer carrier acts on the developer adhering on the surface of the electrostatic latent image carrier.

When the developer remains on the surface of the electrostatic latent image carrier even after the image forming operation, the developer flies within the image forming apparatus, thus bringing about problems of contaminating the inside of the image forming apparatus or of increasing an amount of unnecessary developer as it is recovered by a cleaning unit.

FIG. 16 is a graph showing the relationship between the phase of AC component and the amount of remaining developer when the application of the oscillatory bias voltage is stopped.

As it is apparent from this graph, much toner remains on the surface of the photographic drum depending on the phase of the AC component when the application of the oscillatory bias voltage is stopped, thus contaminating the inside of the image forming apparatus or increasing the unnecessary developer.

Still more, an image forming apparatus using a contact type roller and a brush which contact with the surface of the electrostatic latent image carrier has come to be put into practical use lately as means for transferring developed image data to a transfer medium such as paper. Such image forming apparatus using the contact type roller and the bush has had a problem that developer remaining on the surface of the electrostatic latent image carrier transfers to contact type charging means such as the roller and the brush which contact with the surface of the electrostatic latent image carrier, thus contaminating the contact type charging means such as the roller and the brush.

It has had also another problem that when the surface of the contact type transfer means is contaminated by the developer, the developer transferred to the contact type transfer means adheres on the back of the transfer medium such as paper, thus causing unnecessary contamination and dropping the image quality in printing on the double sides in particular.

Then, there have been technologies for solving the problem caused by the developer remaining on the surface of the electrostatic latent image carrier when the application of the oscillatory bias voltage is stopped as disclosed in Japanese Patent Laid-Open No. Hei. 2-130569 and Patent No. Hei. 4-35074.

The image forming apparatus disclosed in Japanese Patent Laid-Open No. Hei. 2-130569 has been arranged so as to control the oscillatory phase in stopping the oscillatory bias voltage to reduce the developer remaining on the surface of the electrostatic latent image carrier.

The image forming method as disclosed in Japanese Patent No. Hei. 4-35074 has been arranged so as to stop the oscillatory bias voltage by reducing its output amplitude gradually.

However, although the image forming apparatus disclosed in Japanese Patent Laid-Open No. Hei. 2-130569 has been arranged so as to control the oscillatory phase in stopping the oscillatory bias voltage to reduce the developer remaining on the surface of the electrostatic latent image carrier. It has had a problem that it is unable to reduce the remaining developer charged in the reversed polarity and that it is not so effective in one-component developing system because there exist developers which are charged in the polarity reversed from the predetermined polarity.

Further, although the image forming method as disclosed in Japanese Patent No. Hei. 4-35074 has been arranged so as to stop the oscillatory bias voltage by reducing its output amplitude gradually, it has had a problem that it is apt to be costly because it often requires a complicated circuit structure for its high tension power source in order to reduce the output amplitude of the oscillatory bias voltage gradually as described above. It is noted than an oscillatory bias voltage generator using a simple oscillating circuit composed of C-R coupling which has been widely used since the past allows the amplitude of the oscillatory voltage to be reduced gradually in stopping the oscillation from its circuit characteristics if only the output amplitude of the oscillatory bias voltage is to be reduced.

However, the recent image forming apparatus has come to be digitized in order to enhance the image quality, a rectangular wave of arbitrary shape is liable to be used instead of a sine wave for the oscillatory bias voltage applied to the developer carrier and multiple frequencies have come to be used for the frequency of the oscillatory bias voltage. Therefore, the oscillatory bias voltage generator using the simple analog oscillating circuit composed of the C-R coupling of the past also has had a problem that it requires the complex circuit structure for the high tension power source and is costly in order to generate the rectangular wave of arbitrary shape and the oscillatory bias voltage of the multiple frequencies and to reduce the out amplitude of the oscillatory bias voltage gradually.

SUMMARY OF THE INVENTION

The present invention has been made in view of the above circumstances and provides a developing unit, and an image forming apparatus using the same, which is capable of suppressing developer in the middle of a developing process in a developing area from remaining on the surface of an electrostatic latent image carrier when the application of oscillatory bias voltage applied to the developer carrier is stopped and of preventing the inside of the image forming apparatus and each member such as transfer means from being contaminated by the developer, thus allowing a good image to be obtained with a simple circuit structure at low cost.

In order to solve the above-mentioned problem, according to a first aspect of the invention, a developing unit for developing an electrostatic latent image formed on an electrostatic latent image carrier by disposing a developer carrier carrying developer so as to face to the electrostatic latent image carrier and by applying oscillatory bias voltage to the developer carrier is characterized in that the oscillatory bias voltage is stopped after increasing the frequency of the oscillatory bias voltage more than the normal frequency in stopping the oscillatory bias voltage.

According to a second aspect of the invention, a developing unit for developing an electrostatic latent image formed on an electrostatic latent image carrier by disposing a developer carrier carrying developer so as to face to the electrostatic latent image carrier and by applying oscillatory bias voltage to the developer carrier is characterized in that the oscillatory bias voltage is stopped after increasing the frequency of the oscillatory bias voltage stepwise more than the normal frequency in stopping the oscillatory bias voltage.

According to a third aspect of the invention, an image forming apparatus for forming an image by forming an electrostatic latent image on an electrostatic latent image carrier corresponding to desired image data and by applying oscillatory bias voltage to a developer carrier which carriers developer and faces to the electrostatic latent image carrier is characterized in that the oscillatory bias voltage is stopped after increasing the frequency of the oscillatory bias voltage more than the normal frequency in stopping the oscillatory bias voltage.

According to a fourth aspect of the invention, an image forming apparatus for forming an image by forming an electrostatic latent image on an electrostatic latent image carrier corresponding to desired image data and by applying oscillatory bias voltage to a developer carrier which carriers developer and faces to the electrostatic latent image carrier is characterized in that the oscillatory bias voltage is stopped after increasing the frequency of the oscillatory bias voltage stepwise more than the normal frequency in stopping the oscillatory bias voltage.

According to the fifth aspect of the present invention, a developing device for developing an electrostatic latent image formed on an electrostatic latent image carrier is provided. The developing device has a developing unit and a bias control unit. The developing unit has a developer carrier carrying developer so as to face the electrostatic latent image, and the bias control unit applies a normal oscillatory bias voltage to the developer carrier when the developing is implemented and also applies a relatively higher oscillatory bias voltage than the normal oscillatory bias voltage to the developer carrier before applying or the normal bias voltage is terminated.

Next, the inventive developing unit will be explained by exemplifying developing means having a roll-like developer carrier facing to a drum-like electrostatic latent image carrier and applying oscillatory bias voltage in which oscillatory voltage whose waveform is sine wave is superimposed with DC voltage to the developer carrier.

The behavior of the developer during development may be explained as follows.

As shown in FIG. 1, an electric field E whose orientation changes periodically by the oscillatory bias voltage (FIG. 2*a*) applied to a developer carrier 02 is generated between an electrostatic latent image carrier 01 and the developer carrier 02 and charged developer 03 is urged in the direction caused by the generated electric field E and flies and moves reciproactively. Then, an amount of toner remaining on the surface of the electrostatic latent image carrier 01 changes corresponding to the cycle of the oscillatory bias voltage as shown in FIG. 2*i*. Among the developers 03 existing on the surface of the actual developer carrier 02, there exist ones having electric charge opposite from the intended polarity, e.g., plus, and ones having a remarkably low electrification amount, e.g., one whose electrification amount is almost zero, as shown in FIG. 3. They then behave in the opposite way from the above-mentioned developer 03 and are ejected by the moving developer 03. Then, the developer 03 remains on the surface of the electrostatic latent image carrier 01 regardless of the degree of the electrification amount and the polarities as shown in FIGS. 4*a* and 4*b*. Such developer 03 which coincides with the purpose of visualizing the electrostatic latent image is selectively left on the surface of the electrostatic latent image carrier 01 as the developing process proceeds. Thus, the developing operation ends.

Although the oscillatory bias voltage must be stopped before ending the image forming operation of the image forming apparatus, the developer before ending the above-mentioned selective developing process is developed regardless whether or not there exists an electrostatic latent image on the image carrier if the oscillatory bias voltage is simply stopped because the developer having various electrification amount exist in chaos in the developing section during when the oscillatory bias voltage is oscillated. Then, it appears as a belt in the axial direction when rolls are used for the image carrier and the developer carrier like this case.

Such developed developer is mixed with developers having various electrification amounts and existing in the developing section when the oscillatory bias voltage is stopped.

Although it has been known to control the phase of the oscillating part in stopping the oscillation of the oscillatory bias voltage in order to reduce the amount of such developer left on the electrostatic latent image carrier, it has been difficult to control the amount of the unquestionable level because the electrification amounts of the remaining developer vary as described above.

Hitherto, the developer adhering on the image carrier as described above has been cleaned and recovered by a cleaning unit as unnecessary developer and has caused less problem. An oscillatory bias voltage generating unit using a simple oscillating circuit by means of a C-R coupling which has been widely used has hardly caused a trouble because the amplitude of the oscillatory voltage decreases gradually in stopping the oscillation from its circuit characteristics, an absolute amount of the developers which exist in the developing section and in which ones having various electrification amounts are mixed reduces along the attenuation of the amplitude of the oscillatory voltage and the developer amount remaining on the image carrier in stopping the oscillation is reduced as a result.

However, the oscillatory bias voltage generating unit using such simple analog type oscillating circuit by the C-R coupling is unable to accommodate to a digitized image forming apparatus.

Then, according to the invention, the developer amount remaining on the image carrier may be reduced to the extreme by increasing the frequency of the oscillatory bias voltage more than the normal frequency in stopping the application of the oscillatory bias voltage. Its operation may be explained as follows:

In the developing operation carried out by using the oscillatory bias voltage, the optimum value of the oscillating frequency for obtaining the necessary amount of developer amount adhering to the electrostatic latent image on the image carrier exists because the readiness of development changes depending on the developer amount, size, weight of the developer and the amplitude of the oscillatory bias voltage. The developing operation becomes hard when the value is higher or lower than that. Accordingly, the absolute amount of the developers which exist in the developing section and in which ones having various electrification amounts are mixed may be reduced by increasing the frequency of the oscillatory biased voltage.

The amount of developer adhering to the image carrier in stopping the application of the oscillatory bias voltage is approximately proportional to the absolute amount of the developers which exist in the developing section and in which ones having various electrification amounts are mixed, so that it is possible to suppress the developer amount remaining on the image carrier in stopping the oscillatory bias voltage to little by changing the frequency high in advance in stopping the oscillation of the oscillatory bias voltage.

An image forming apparatus of the type of applying oscillatory bias voltage to charge the image carrier which is seen lately often causes base contamination on the image carrier as voltage for charging the image carrier changes periodically or the developing electric field fluctuates periodically when the oscillating frequency interferes mutually with the frequency of the oscillatory voltage used for the developing operation.

While it is conceivable to set the frequencies of the both so as to hardly interfere each other in order to avoid this problem, it is possible to avoid this phenomenon by the invention by changing the frequency stepwise by a plurality of jumped values in stopping the oscillatory bias voltage.

Because the amplitude of the oscillatory bias voltage to be outputted is constant by this method, the structure of the power circuit may be simplified and the cost may be reduced.

The waveform of the oscillating component of the oscillatory bias voltage needs not be a sine wave. It may be a rectangular wave, a triangular wave, a pulse wave or the like as long as it is a cyclic AC waveform. It contains voltage created by periodically turning ON-OFF the DC component.

The above and other advantages of the invention will become more apparent in the following description and the accompanying drawings in which like numerals refer to like parts.

DESCRIPTION OF THE PREFERRED EMBODIMENTS

The invention will be explained below based on modes for carrying out the invention as shown in the figures. (First Mode)

Figure 1:
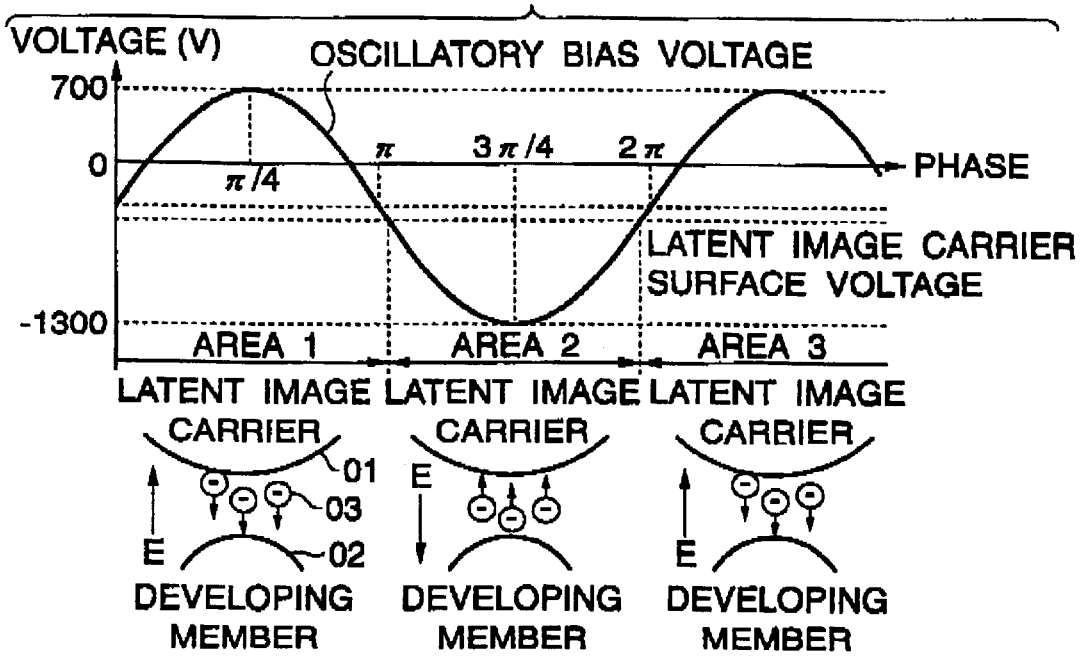
FIG. 1 is a conceptual diagram showing the principle of development of a developing unit of the invention.
Figure 2A:
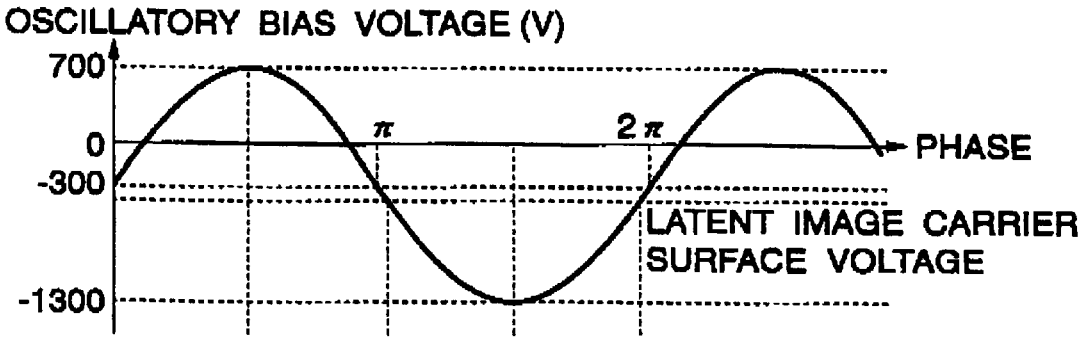
FIGS. 2A and 2B are graphs showing oscillatory bias voltage and a toner amount remaining on an electrostatic latent image carrier, respectively.
Figure 2B:
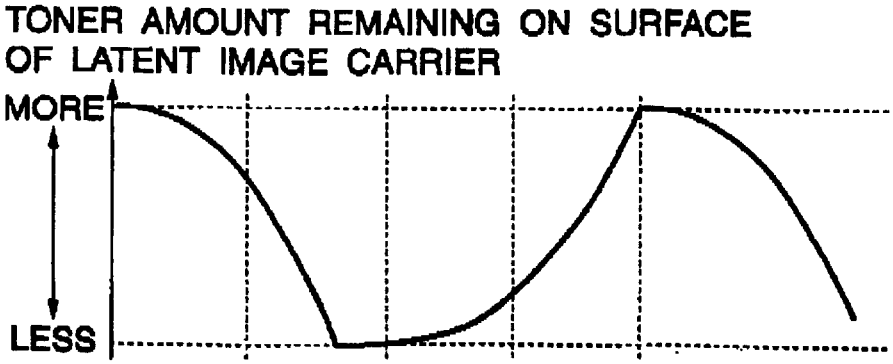
Figure 3:
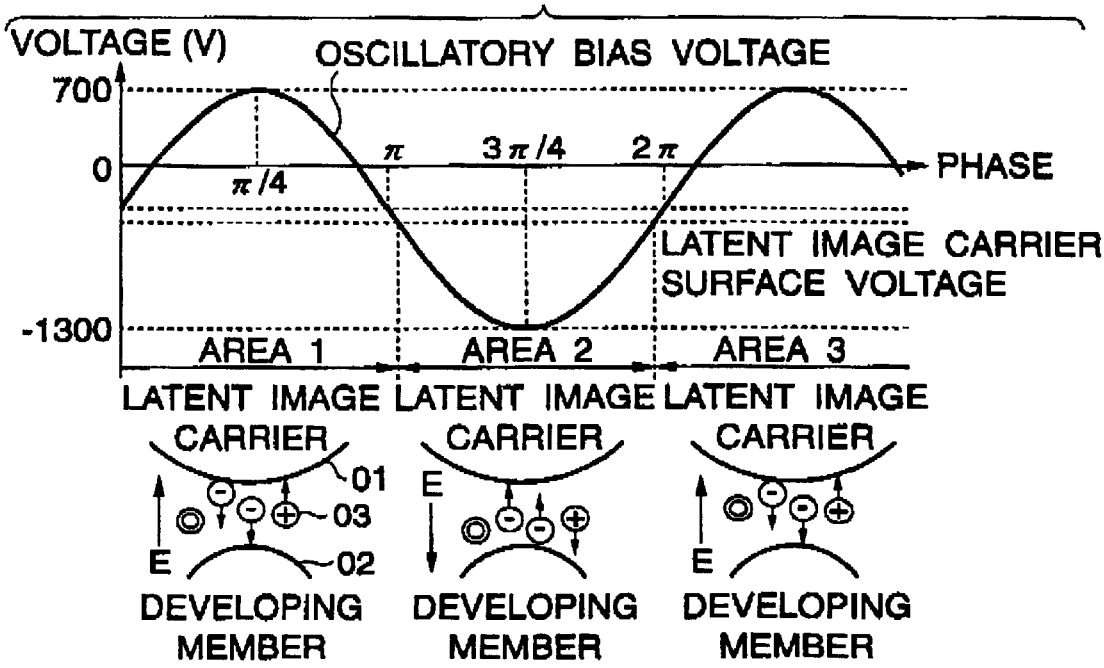
FIG. 3 is a conceptual diagram showing the principle of development of a developing unit of the invention.
Figure 4A:
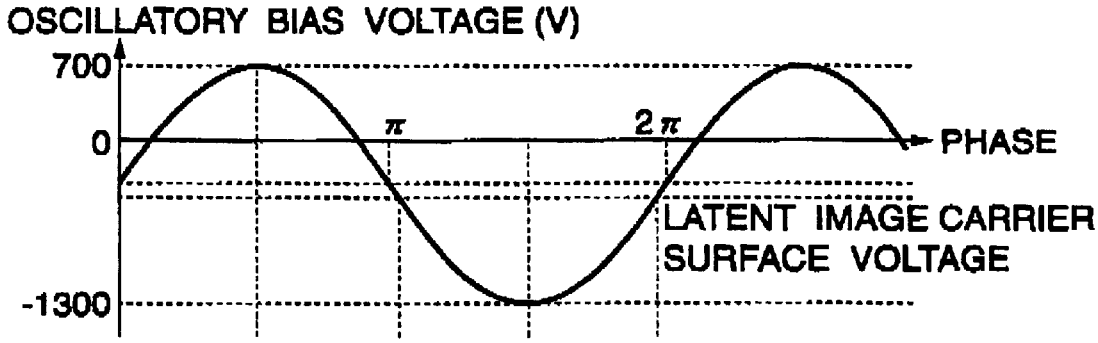
FIGS. 4A and 4B are graphs showing oscillatory bias voltage and a toner amount remaining on an electrostatic latent image carrier, respectively.
Figure 4B:
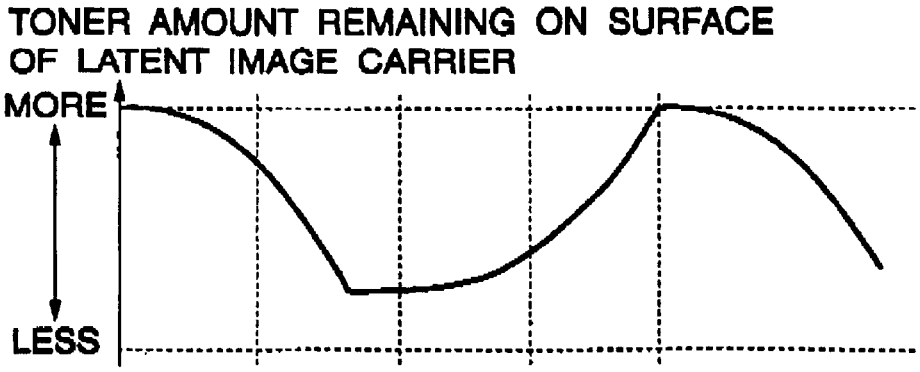
Figure 5:
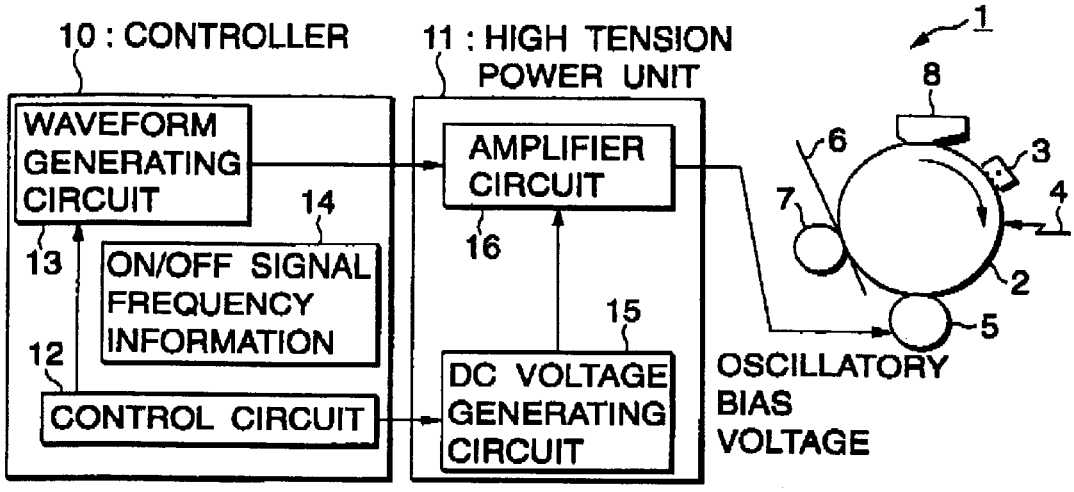
FIG. 5 is a diagram showing the struction of a page printer to which the developing unit of a first embodiment of the invention is applied.

FIG. 5 shows a desk-top page printer of electrophotographic type as an image forming apparatus to which a developing unit of a first mode of the invention is applied.

As shown in FIG. 5, a page printer 1 comprises a photograph drum 2 as an electrostatic latent image carrier, charging means 3 for charging the surface of the photograph drum 2 to predetermined potential, image exposing means for forming an electrostatic latent image by implementing image exposure 4 on the surface of the photographic drum 2, developing means having a developing roll 5 as a developer carrier for developing the electrostatic latent image formed on the surface of the photographic drum 2, a transfer roll 7 as a transfer means for transferring the developed image developed by the developing means to a copy sheet 6 and cleaning means 8 for removing developer remaining on the photographic drum 2.

The photographic drum 2 is rotated at processing speed of about 100 mm/s for example. A scorotron in which DC voltage is applied to a corona wire is used as the charging means 3. A developing unit using magnetic one-component toner as the developer is used as the developing means.

It is noted that the page printer 1 described above is arranged so as to be able to replace the photographic drum 2 and others in a body by construction the photographic drum 2, the developing unit, the cleaning unit 8 and other in a body as a process cartridge. The page printer 1 also comprises a double side unit not shown so as to be able to form images on the both sides of the copy sheet 6.

By the way, in the developing unit in which the developer carrier carrying the developer is disposed facing to the electrostatic latent image carrier and oscillatory bias voltage is applied to the developer carrier to develop the electrostatic latent image formed on the electrostatic latent image carrier, this mode is arranged is arranged so as to stop the application of the oscillatory bias voltage after increasing the frequency of the oscillatory bias voltage more than the normal one.

FIG. 5 also shows the electrical circuit of the page printer constructed as described above.

The electrical circuit of the page printer described above is roughly composed of a controller 10 and a high tension power unit 11. The controller 10 comprises a control circuit 12 comprised CPU and other for outputting ON/OFF signals composed of digital signals and frequency information 14 to a waveform generation circuit 13 and outputting a signal to a DC voltage generating circuit 15 of the high tension power unit 11. In response to the digital signal from the control circuit 12, the waveform generating circuit 13 generates AC voltage of predetermined waveform and frequency. The AC voltage of the predetermined waveform and frequency generated by the waveform generating circuit 13 is amplified to AC voltage having a predetermined peak-to-peak voltage by an amplifier circuit 16 of the high tension power unit 11. It is then superimposed with DC voltage generated by the DC voltage generating circuit 15 to generate predetermined oscillatory bias voltage in the amplifier circuit 16 of the high tension power unit 11 to be applied to the developing roll 5 of the developing means.

Then, the control circuit 12 controls the frequency information outputted to the waveform generating circuit 13 and is arranged so as to stop the application of the oscillatory bias voltage after increasing the frequency of the oscillatory bias voltage more than the normal one.

By arranging as described above, the page printer to which the developing unit of the present mode is applied is capable of suppressing the developer on the way of the developing process from remaining on the surface of the electrostatic latent image carrier in stopping the application of the oscillatory bias voltage applied to the developer carrier and of preventing the inside of the image forming apparatus and the respective members such as the transfer means from being contaminated by the developer as described later, thus allowing a good image to be obtained with the simple circuit structure at low cost.

That is, in the page printer 1 described above, the electrostatic latent image corresponding to the image data is formed on the photographic drum 2 by implementing the image exposure 4 after charging the surface of the photographic drum 2 to the predetermined potential by the charging means 3 composed of the scorotron as shown in FIG. 5. The electrostatic latent image formed on the photographic drum 2 is developed by the developing roll 5 as the developing means.

AT this time, the developing operation for developing the electrostatic latent image formed on the photographic drum 2 is carried out by applying the oscillatory bias voltage in which the oscillating high voltage is superimposed with the DC component to a developing sleeve of the developing roll 5, i.e., the developer carrier, to fly the charged developer reciprocativley and to adhere to a latent image section. During the development operation, so-called toner cloud in which toner having various electrification amounts exists in chaos centering on the predetermined charge polarity in a gap (developing area) where the developing sleeve faces to the photographic drum 2 and the electrostatic latent image is developed by good charged toner selectively as the developing process proceeds.

Next, when the application of high tension is stopped instantly as it is in stopping the application of the oscillatory bias voltage to the developing sleeve as the image forming operation ends, the toner cloud existing at the developing section adheres on the photographic drum 2 even though there is not electrostatic latent image, thus causing a belt like base fogging along the axial direction of the photographic drum 2.

By the way, the weight of the toner recovered by the cleaning unit including the weight of toner which has become the base fogging along the axial direction of the photographic drum 2 turned out to be about 7% in weight as compared to the toner filled in a new process cartridge until when the life of the process cartridge ends in the conventional page printer because the application of the oscillatory bias voltage is stopped per page during the printing operation.

Further, the toner contamination of a non-printing section (sheet feeding gap section) on the photographic drum 2 contaminated the surface of the contact type transfer roller and appeared as a band of the toner contamination on the back of the next sheet during the continuous printing operation. It turned out to be a deadly trouble in a double side printer. Although an operation for electrically cleansing the transfer unit is added in the operation sequence of the unit because the toner contamination remains and accumulates on the surface of the transfer roll after ending the printing job, the effect of the electrical cleaning is not so great because the toner remaining on the photographic drum has various electrification amounts.

Then, the developing unit is arranged so as to stop the developing bias after changing the frequency to the twice or more of the normal frequency of the developing operation in stopping the developing bias in the present mode.

The motion of the developer cannot follow the change of the quick developing electric field when the frequency is increased to the twice or more than normal frequency and the toner cloud decreases remarkably. Accordingly, the amount of toner remaining on the photographic drum 2 becomes very little and no trouble occurs when the oscillation of the developing bias is stopped at this time.

Figure 6:
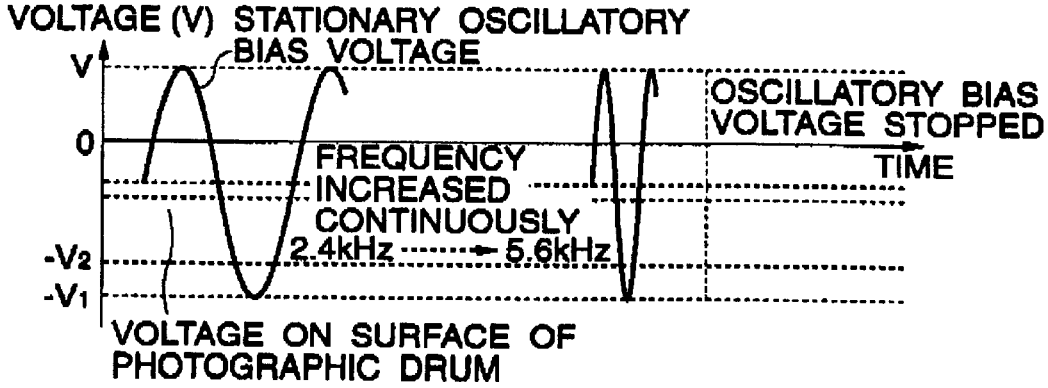
FIG. 6 is a waveform chart showing the state when the oscillatory bias voltage is applied.
Figure 7:
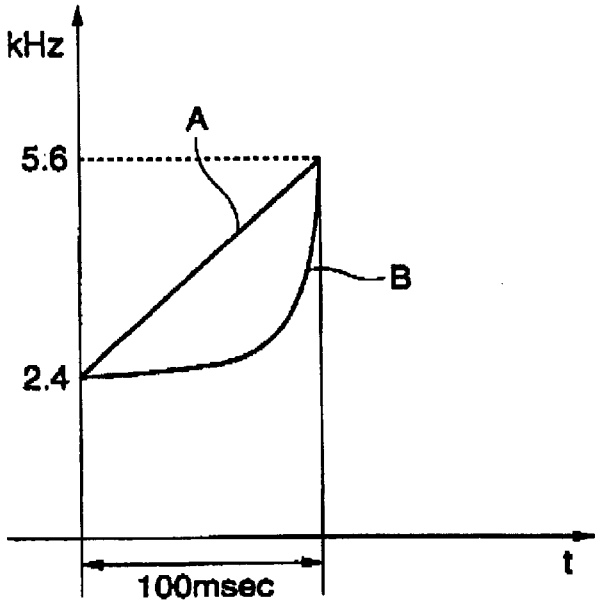
FIG. 7 is a graph showing frequency of the oscillatory bias voltage.

In concrete, while the developing frequency was 2.4 kHz during the normal time as shown in FIGS. 6 and 7, it was stopped after increasing up to 5.6 kHz continuously in a time of 100 ms in stopping the oscillation. No effect of reducing the toner remaining on the photographic drum was seen when the frequency in stopping the oscillation was 4 kHz or less as a result of study. The final frequency in stopping the oscillation cannot be said as how many times of the frequency of the normal oscillation which is optimized in terms of the image quality and is considered to be different pending on the weight of the toner, the electrification amount, the amplitude of the AC component of the developing bias and the distribution of electrification amount of the toner.

It is noted that the developing frequency needs not be always increased straightly as indicated by A in FIG. 7 but may be set so as to increase sharply just before the stop as indicated by B in FIG. 7.

The toner amount recovered after changing the developing bias stopping method has been reduced to around 3% in weight as compared to the toner filled in the process cartridge. Thereby, a number of sheets printable by the process cartridge increased by about 3%.

It eliminated the belt-like base fogging in printing on the double sides, improved the image quality remarkably, improved the efficiency of the cleaning operation of the transfer unit, allowed a number of times of cleansing operations to be reduced and increased the operating efficiency of the unit. (Second Mode)

Figure 8:
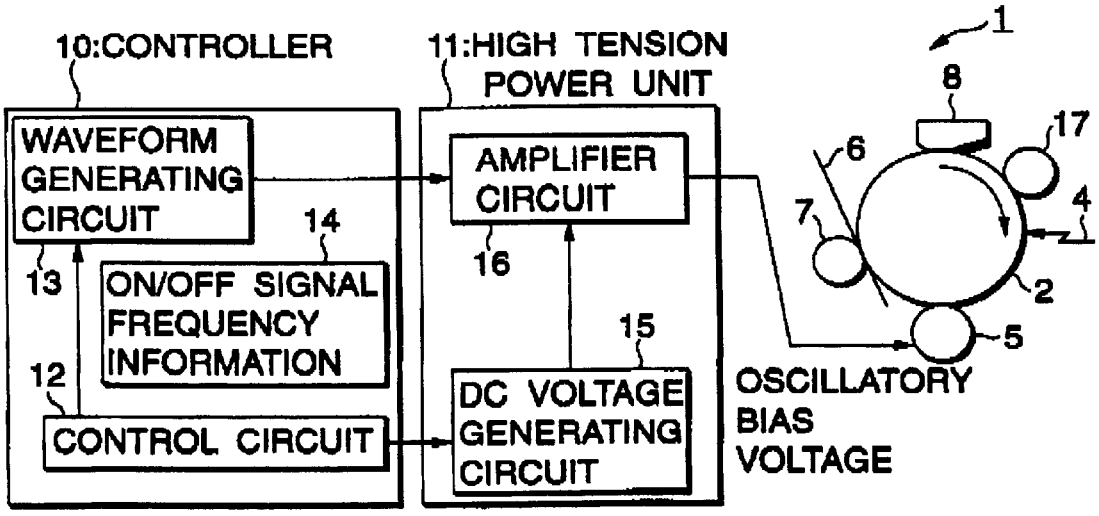
FIG. 8 is a diagram showing the structure of a page printer to which the developing unit of a second embodiment of the invention is applied.

FIG. 8 shows a second mode of the invention. The same reference numerals in the figure denote the same parts in the first mode. In the second mode, the developing unit is arranged so as to stop the application of the oscillatory bias voltage after increasing the frequency of the oscillatory bias voltage stepwise more than the normal frequency in stopping the application of the oscillatory bias voltage.

That is, in the page printer 1 in which the developing unit of the second mode is applied uses the charging means 3 not the scorotron but a contact type charging roll 17 for charging the surface of the photographic drum to predetermined potential by contacting with the surface of the photographic drum 2. The charging roll 17 is arranged so as to apply AC voltage of 800 Hz for example to which DC voltage is superimposed.

Because of the AC voltage is applied to the charging means 17 in the second mode, base fogging occurs along the axial direction of the photographic drum 2 when it interferes with the frequency of the AC component of the developing bias by the periodic change of the charged potential of the photographic drum 2 in the interfere frequency and the fluctuation of the DC component of the developing bias.

Then, in the second mode, the developing unit is arranged so as not to cause the interference of the frequencies from each other or so as not to cause any problem in terms of printed image quality even when it occurs in setting the normal frequencies of the AC voltage and the AC component of the developing bias to be applied to the charging means 17.

When the application of the oscillatory bias voltage was stopped after changing the oscillating frequency up to the frequency which is twice or more of the normal oscillation in the developing operation in the same manner with the first mode in stopping the application, a belt-like toner was caused along the axial direction of the photographic drum 2. When the cause of the adhesion of toner was investigated in detail, it was found to be base fogging which was caused because the frequency of the oscillatory bias voltage increased continuously passes through frequency where it resonates strongly with frequency (800 Hz) of the oscillating voltage applied to the charging means 17.

Figure 9:
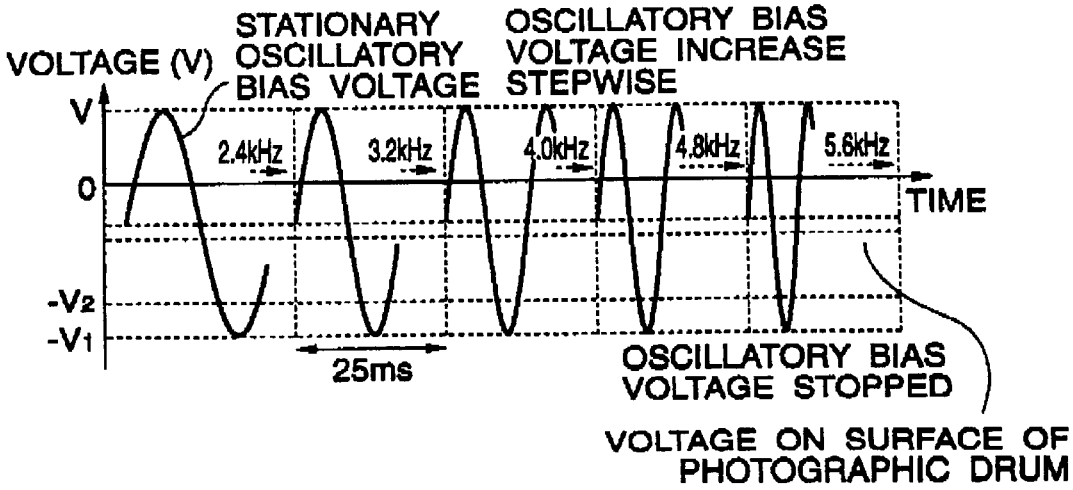
FIG. 9 is a waveform chart showing the state when the oscillatory bias voltage is applied.

Then, in the second mode, while the developing frequency was 2.4 kHz during the normal time and was increased up to 5.6 kHz in stopping the oscillation in the same manner with the first mode, its interval was changed stepwise by integer times of the frequency (800 Hz) of the oscillating voltage applied to the charging means 17 like 3.2 kHz, 4.0 kHz and 4.8 kHz and the oscillating time of each frequency was set at 25 ms each as shown in FIG. 9. The oscillation was stopped at the time of 100 ms in the same manner with the first mode.

Since the same effect with the first mode could be obtained by changing the developing bias stopping method and the time required for stopping the developing bias did not change, it is possible to accommodate with the modification of system of the charging means without largely changing the apparatus control sequence.

The other arrangement and effect of the second mode are the same with those of the first mode, so that its explanation will be omitted here. (Preferred Embodiments)

The invention will be explained below based on preferred embodiments shown in the figures.

Figure 10:
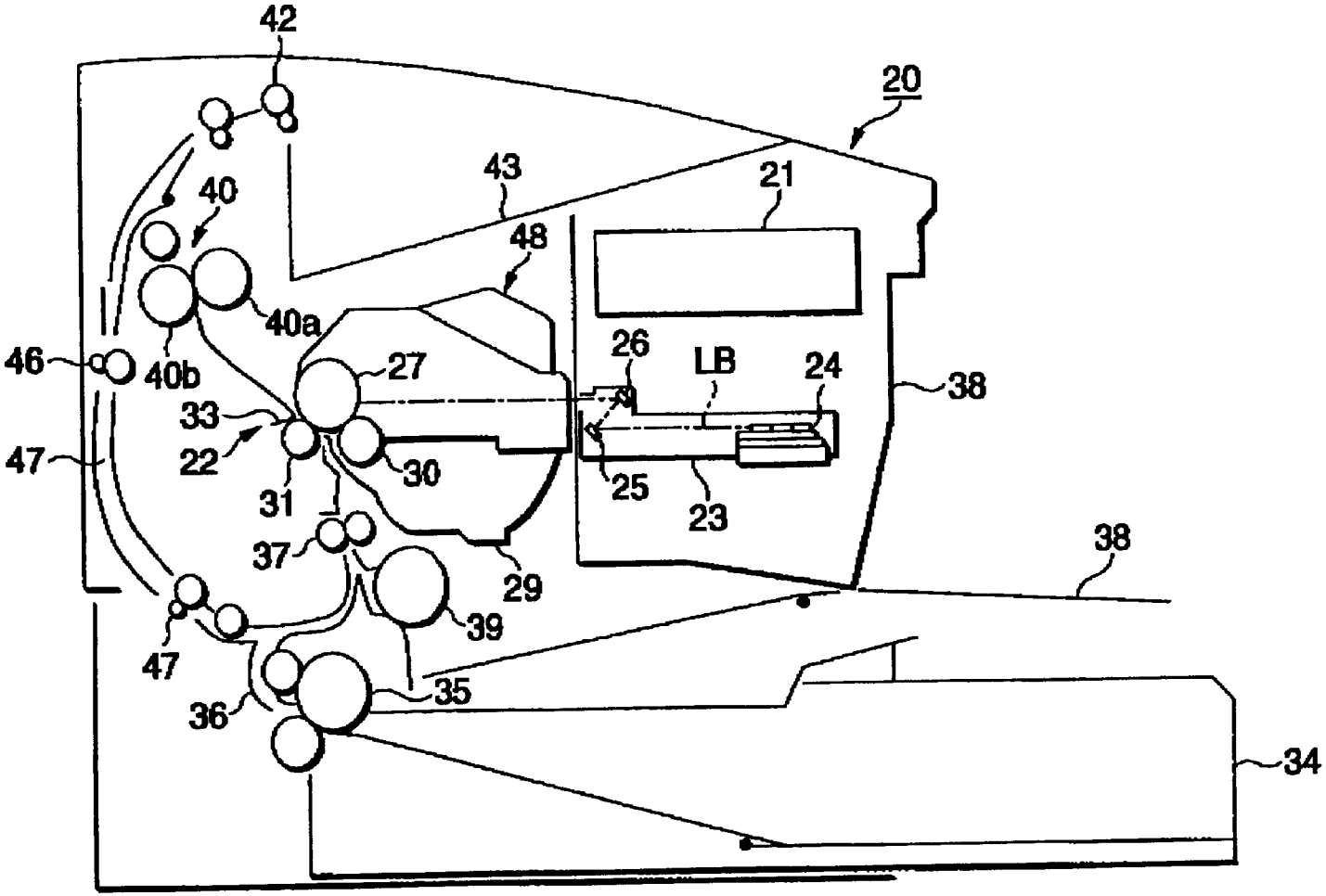
FIG. 10 is a diagram showing the structure of a page printer to which the developing unit of another embodiment of the invention is applied.

FIG. 10 is a schematic diagram showing the structure of a desk-top page printer of electrophotographic type as an image forming apparatus of the present embodiment.

In FIG. 10, the reference numeral (20) denotes the body of the page printer. Disposed within the page printer body 20 are an image processing section 21 for implementing predetermined image processing to image data inputted from the outside and an image output section 22 for outputting an image based on the image data to which the predetermined image processing has been implemented by the image processing section 21. Image information sent from a host computer like a personal computer not shown or via a communication line such as a telephone line and LAN and image data read by an image reader not shown are inputted to the image processing section 21 in the page printer body 20.

A ROS(Raster Output Scanner) 23 for exposing an image based on the image data to which the predetermined image processing has been implemented by the image processing section 21 is disposed by the image output section 22 of the page printer body 20. The exposure of image is carried out by the ROS 23 by means of a laser beam LB corresponding to the image data.

In the ROS 23, the laser beam LB is emitted from a semiconductor laser not shown corresponding to gradation data of the image data as shown in FIG. 10. The laser beam LB emitted from the semiconductor laser is deflected and scanned by a rotary polygon mirror 24 and is scanned on a photographic drum 27, i.e., an electrostatic latent image carrier, via reflecting mirrors 25 and 26.

Figure 11:
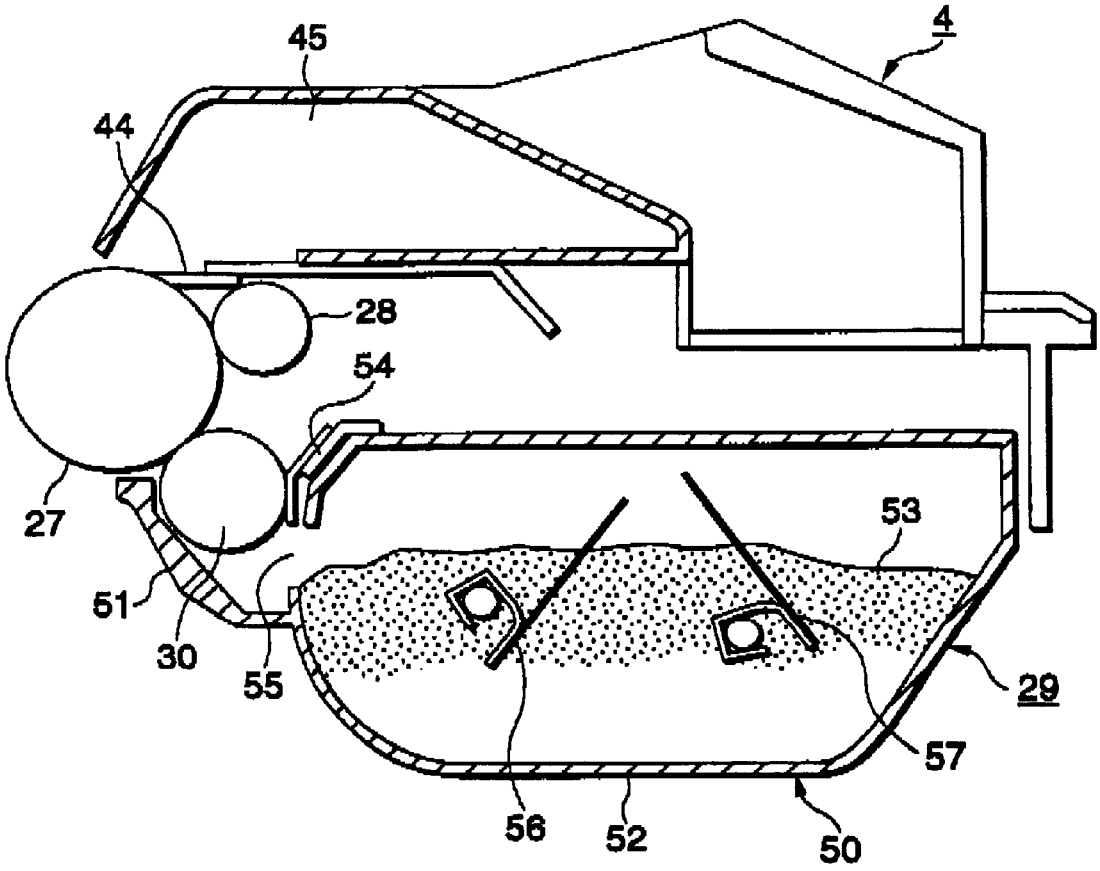
FIG. 11 is a diagram showing the structure of a process cartridge including the developing unit of the embodiment of the invention.

A photosensitive material using an organic photoconductive compound (OPC) for example is used for the photographic drum 27 on which the laser beam LB is scanned and exposed by the ROS 23. The photographic drum 27 is rotated at predetermined speed along the direction of arrow by driving means not shown. The electrostatic latent image is formed on the surface of the photographic drum 27 by scanning and exposing the laser beam LB corresponding to the image data after charging the surface at the predetermined potential by a charging roll 28 as the charging means in advance as shown in FIG. 11. The electrostatic latent image formed on the photographic drum 27 is then developed as a toner image by the developing roll 30 as the developer carrier of the developing unit 29. The toner image formed on the photographic drum 27 is transferred on to the copy sheet 32 as a transfer medium by a transfer roll 31 disposed so as to contact with the photographic drum 27 and a copy sheet 32 on which the toner image has been transferred is separated from the photographic drum 27 as it is de-electrified by the detaching charger 33 having a needle-like electrode. AC voltage or AC voltage on which DC voltage is superimposed is applied to a detaching charger 33 having the needle-like electrode. The copy sheet 32 is fed from a sheet cassette 34 disposed at the lower part of the page printer body 20 by a feeder roll 35 as shown in FIG. 10. The fed copy sheet 32 is then conveyed to the surface of the photographic drum 27 by a conveyor roll 36 and a resist roll 37.

It is noted that the page printer body 20 has a manual feed tray 38 on the right side as shown in FIG. 10. A transfer medium or different material and size such as OHP sheets and mail cards may be also fed from the manual feed tray 38 via feeder roll 39 having a large diameter by turning the manual feed tray 38 clockwise and stopping it at the approximately horizontal position.

Figure 12:
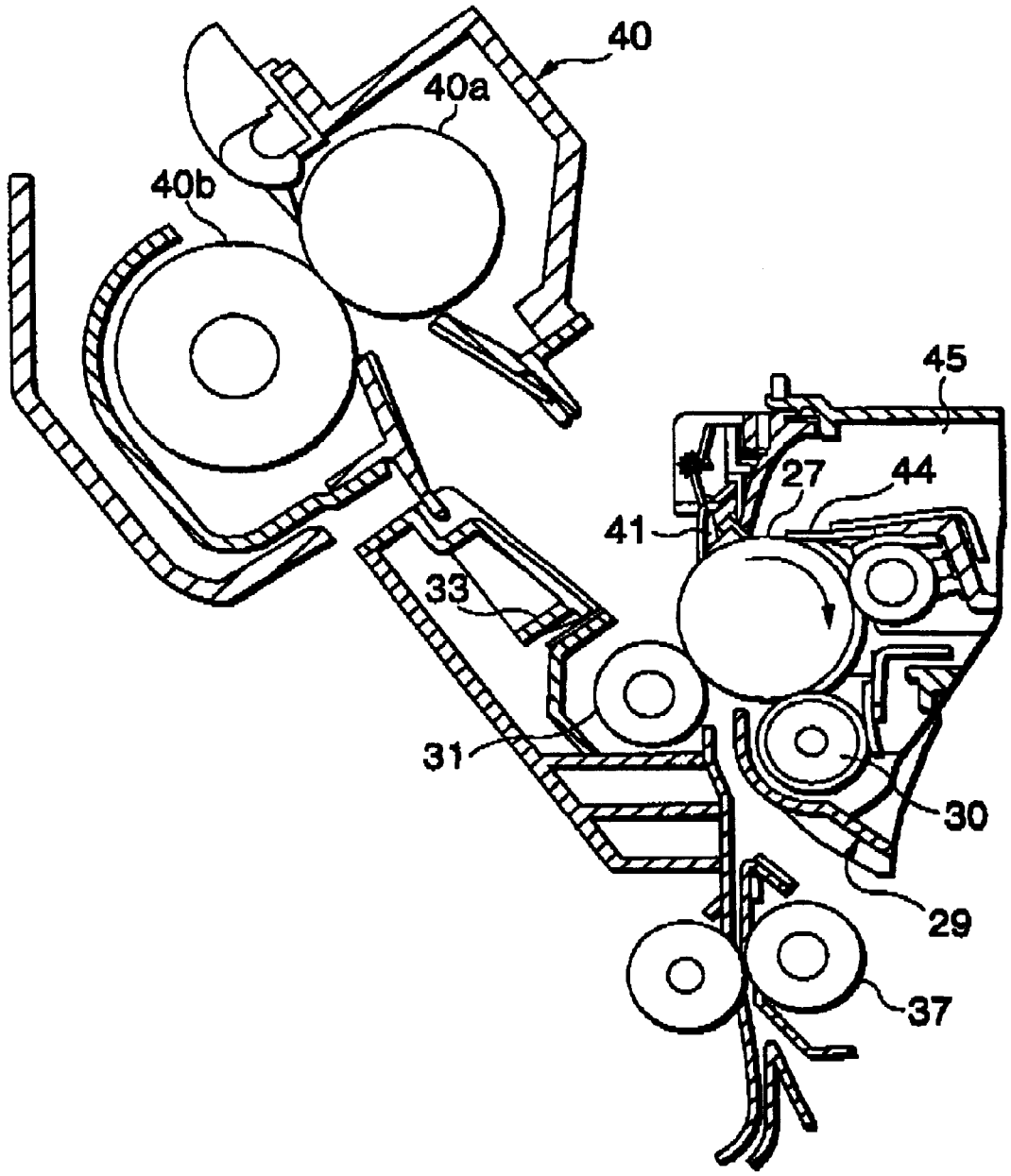
FIG. 12 is a diagram showing the structure of an image forming section of the page printer to which the developing unit of the embodiment of the invention is applied.

The copy sheet 32 on which the toner image has been transferred from the photographic drum 27 is conveyed to a fixing section 40 after being de-electrified by the detaching charger 33 having the needle-like electrode and separated from the surface of the photographic drum 27 as described above. A peeling claw 41 is provided as shown in FIG. 12 to forcibly peel the copy sheet 32 from the surface of the photographic drum 27 when it is not peeled by itself from the surface of the photographic drum 27 by the de-electrification of the detaching charging 33, the radius of curvature of the photographic drum 27 and the rigidity of the copy sheet 32. The toner image of the copy sheet 32 separated from the surface of the photographic drum 27 is fixed to the copy sheet 32 by heat and pressure of a heating roll 40*a* and a pressurizing roll 40*b* of the fixing section 40. Then, the copy sheet 32 is discharged on a discharge tray 43 provided at the upper part of the page printer body 20 by a discharge roll 42. Thus, the image forming process ends.

In printing images on the both sides of the copy sheet 32, the copy sheet 32 in which the image is printed on one side is not discharged to a discharge tray 43 as it is as shown in FIG. 10. The discharge roll 42 is reversed to guide the copy sheet 32 to a double side unit 47 having a plurality of conveyor rolls 46 to convey to the transferring position of the photograph drum 27 again while reversing the sides of the copy sheet 32.

It is noted that the remaining toner and paper dust on the surface of the photographic drum 27 after ending the toner image transferring process are removed by a cleaning unit 45 having a cleaner blade 44 as shown in FIG. 11 to be ready for the next image forming process.

In the page constructed as described above, the photographic drum 27 and its peripheral developing unit 29, the cleaning unit 45 and others are united in a body as a process cartridge 48 in order to enhance the maintainability as shown in FIG. 11. The process cartridge 48 is removable in a body from the page printer body 20. The process cartridge 48 is also set so that the deterioration time of the photographic drum 27 coincides approximately with the time when the developer within the developing unit 39 is consumed. Accordingly, when the photographic drum 27 wears and deteriorates and when the developer within the developing unit 29 is consumed, the maintainability may be improved not by replacing the photographic drum 27, the developing unit 29 and others individually with new one but replacing the photographic drum 27, the developing unit 29 and others in body by removing them from the page printer body 20 as the process cartridge 48.

FIG. 11 is a diagram showing the structure of the developing unit used in the page printer together with the whole process cartridge.

As shown in FIG. 11, the developing unit 29 has a developing unit housing 50. The developing unit housing 50 comprises, roughly, a developing tank 51 by which the developer roll 30 as the developer carrier is provided and a developer storage tank 52 provided continuously behind the developing tank 51. The developing roll 30 is a rotably disposed by the developing tank 51 of the developing unit housing 50 at the edge portion thereof on the side of the photographic drum 27. The developing roll 30 is composed of a magnet roll not shown on which magnetic pole of predetermined polarity is magnetized at predetermined position and is disposed in the fixed state and a developing sleeve not shown rotably disposed at the outer periphery of the magnet roll along the direction of arrow.

A developing agitator not shown which is formed in the shape of plate or rod for supplying the developer to the developing roll 30 while agitating it is rotably provided as necessary at the lower caterconered part. A charging blade 54 as a charging member for charging one-component magnetic developer (toner) 53 adsorbed to the outer periphery of the developing roll 30 by the magnetic force of the magnetic roll not shown to the predetermined polarity by frictional electrification is provided by the outer periphery of the developing roll 30. The whole charging blade may be created by synthetic resion or the like or it may be constructed by a plate spring member made of metal or the like and a frictional electrification member made of synthetic resion or the like fixed to the edge portion of the plate spring member by means of bond or the like. The base portion of the charging blade 54 is fixed to the developing unit housing 50 and its edge portion is pressed to the surface of the developing roll 30 with predetermined pressure.

An opening 55 for controlling an amount of the developer 53 to be supplied from the developer storage tank 52 to the developing tank 51 is provided between the developing tank 51 constructed as described above and the developer storage tank 52 continuously provided at the rear side of the developing tank 51. A plurality of ribs not shown for partitioning the opening 55 at predetermined intervals along the longitudinal direction thereof are provided as necessary in the opening 55.

The developer storage tank 52 is constructed largely so as to be able to stock the developer 53 composed of the magnetic one-component toner by a predetermined amount. The developer stocking rate of the developer storage tank 52, i.e., the ratio of the developer 53 to the capacity of the developer storage tank 52 is set at 60 to 70% for example. Two developer agitating and conveying members 56 and 57 for conveying the developer 53 stocked within the developer storage tank 52 to the developing tank 51 while agitating it are provided turnably within the developer storage tank 52. these two developer agitating and conveying members 56 and 57 are rotated at predetermined timing by a driving motor not shown for driving the photographic drum 27 and others via gears and the like provided on the back of the developing unit 29.

By the way, in the developing unit in which the developer carrier carrying the developer is disposed facing to the electrostatic latent image carrier and oscillatory bias voltage is applied to the developer carrier to develop the electrostatic latent image formed on the electrostatic latent image carrier, the present embodiment is arranged so as to stop the application of the oscillatory bias voltage after increasing the frequency of the oscillatory bias voltage stepwise more than the normal one.

Figure 13:
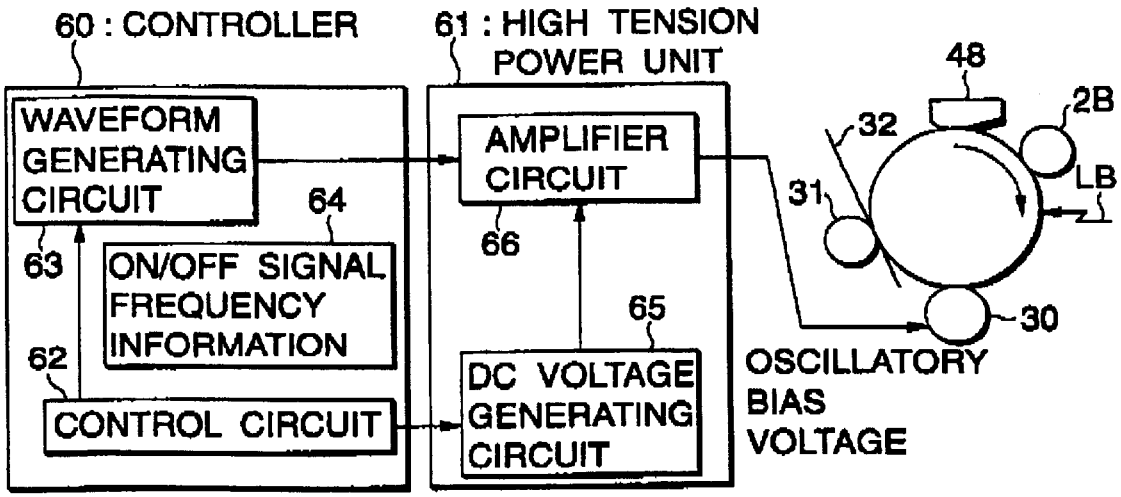
FIG. 13 is a diagram showing the structure of an electrical circuit of the page printer to which the developing unit of the embodiment of the invention is applied.

FIG. 13 also shows the electrical circuit of the page printer constructed as described above.

Figure 14:
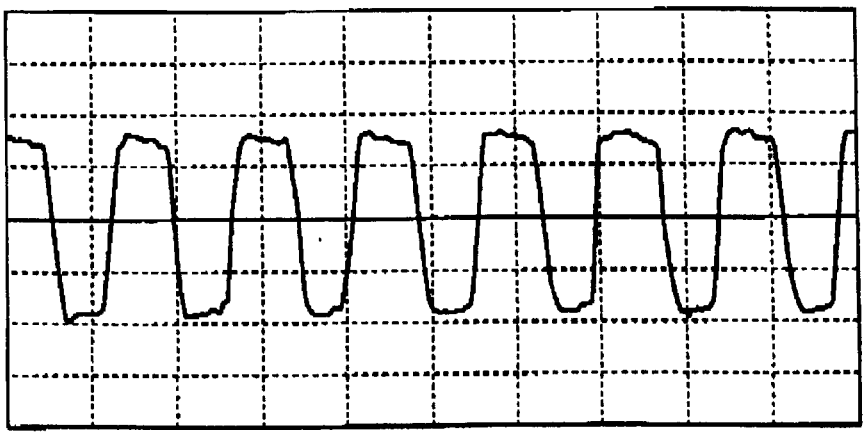
FIG. 14 is a waveform chart showing an oscillatory bias voltage.

The electrical circuit of the page printer described above is roughly composed of a controller 60 and a high tension power unit 61. The controller 60 comprises a control circuit 62 comprised CPU and other for outputting ON/OFF signals composed of digital signals and frequency information 64 to a waveform generating circuit 63 and outputting a signal to a DC voltage generating circuit 65 of the high tension power unit 61. In response to the digital signal from the control circuit 62, the waveform generating circuit 63 generates AC voltage of predetermined waveform and frequency. The AC voltage of the predetermined waveform and frequency generated by the waveform generating circuit 63 is amplified to AC voltage having a predetermined peak-to-peak voltage by an amplifier circuit 66 of the high tension power unit 61. It is then superimposed with DC voltage generated by the DC voltage generating circuit 65 to generate rectangular oscillatory bias voltage as shown in FIG. 14 in the amplifier circuit 66 of the high tension power unit 61 to be applied to the developing roll 30 of the developing unit 29.

Then, the control circuit 62 controls the frequency information outputted to the waveform generating circuit 63 and is arranged so as to stop the application of the oscillatory bias voltage after increasing the frequency of the oscillatory bias voltage stepwise more than the normal one.

By arranging as described above, the page printer to which the developing unit of the present mode is applied is capable of suppressing the developer on the way of the developing process from remaining on the surface of the electrostatic latent image carrier in stopping the application of the oscillatory bias voltage applied to the developer carrier and of preventing the inside of the image forming apparatus and the respective members such as the transfer means from being contaminated by the developer as described later, thus allowing a good image to be obtained with the simple circuit structure at low cost.

That is, in the page printer 1 described above, the electrostatic latent image corresponding to the image data is formed on the photographic drum 27 by implementing the image exposure by the ROS 23 after charging the surface of the photographic drum 27 to the predetermined potential by the charging roll 31 as shown in FIG. 10. The electrostatic latent image formed on the photographic drum 27 is developed by the developing roll 30 of the developing unit 29.

The developing operation for visualizing the electrostatic latent image formed on the photographic drum 27 is carried out by applying the rectangular oscillatory bias voltage as shown in FIG. 14 in which the oscillating high voltage is superimposed with the DC component to a developing sleeve of the developing roll 30 to fly the charged developer 53 reciprocativley and to adhere to a latent image section. During the developing operation so-called toner cloud in which toner having various electrification amounts exists in chaos centering on the predetermined charge polarity in a gap (developing area) where the developing sleeve faces to the photographic drum 27 and the electrostatic latent image is developed by good charged toner selectively as the developing process precedes.

Then, the developing unit is arranged so as to stop the developing bias after changing the frequency stepwise to the twice or more of the normal frequency of the developing operation in stopping the developing bias in the present mode.

The motion of the developer cannot follow the change of the quick developing electric field when the frequency is increased to the twice or more the normal frequency and the toner cloud decreases remarkably. Accordingly, the amount of toner remaining on the photographic drum becomes very little and no trouble occurs even when the oscillation of the developing bias is stopped at this time.

In concrete, while the developing frequency was 2. 4 kHz during the time, it was stopped after increasing stepwise up to 5.6 kHz in a time of 100 ms in stopping the oscillation. No effect of reducing the toner remaining on the photographic drum was seen when the frequency in stopping the oscillation was 4 kHz or less as result of study. The final frequency in stopping the oscillation cannot be said as how many times of the frequency of the normal oscillation which is optimized for the image quality and is considered to be different depending on the weight of toner, the electrification amount, the amplitude of AC component of the developing bias and the distribution of electrification amount of the toner.

The toner amount recovered after changing the developing bias stopping method has been reduced to around 3% in weight as compared to the toner filled in the process cartridge. Thereby, a number of sheets printable by the process cartridge increased by about 3%.

It also eliminated the belt-like base fogging in printing on the double sides, improved the image quality remarkably, improved the efficiency of the cleaning operation of the transfer unit, allowed a number of times of cleaning operations to be reduced and increased the operating efficiency of the unit.

Figure 15:
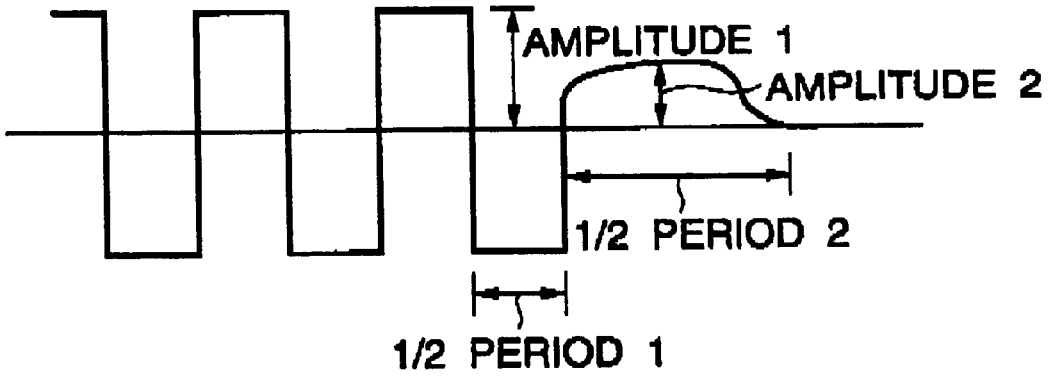
FIG. 15 is a waveform chart showing another oscillatory bias voltage.
Figure 16:
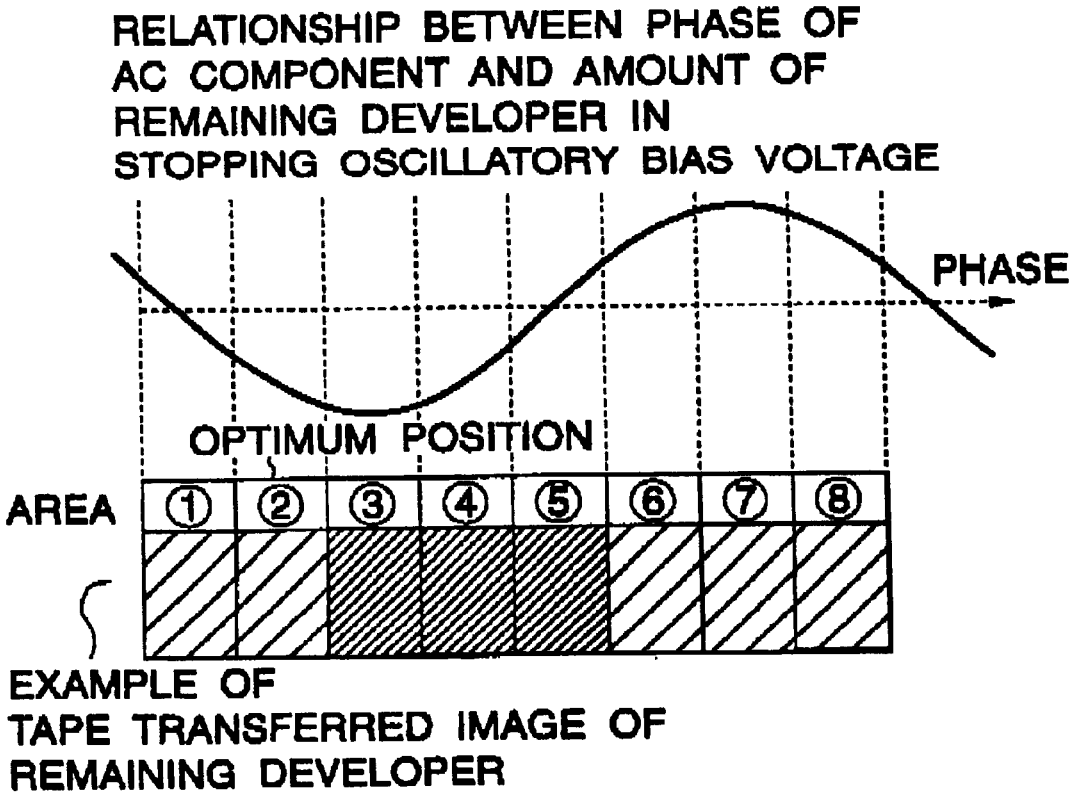
FIG. 16 is a graph showing the relationship between the phase of AC component and an amount of remaining developer when the application of the oscillatory bias voltage of the past is stopped.

It is noted that although the phase of the oscillating component in stopping the application of the oscillatory bias voltage has not been defined specifically, the phase of the oscillating component in stopping the application of the oscillatory bias voltage may be set so as to be located in generating force opposite from the force in urging the developer to the electrostatic latent image carrier in developing the electrostatic latent image as shown in FIG. 15.

Thereby, it is possible to prevent the developer charged in the normal charge polarity from remaining on the electrostatic latent image carrier more effectively.

The output just before stopping the application of the oscillatory bias voltage may be also set so as to have a voltage peak which is different from the normal time (lower than the normal ones) as shown in FIG. 15.

Further, the phase of the oscillating component in stopping the application of the oscillatory bias voltage may be set so as to be located in generating the force opposite from the force in urging the developer to the electrostatic latent image carrier in developing the electrostatic latent image and so that the oscillating component just before stopping the application has wavelength different from the normal time (wavelength longer than normal one for example) as sown in FIG. 15.

Thereby, it is possible to prevent the developer charged in the normal charge polarity from remaining on the electrostatic latent image carrier more effectively.

Further, the frequency to be set higher than the normal frequency in increasing the frequency of the oscillatory bias voltage than the normal frequency in stopping the application of the oscillatory bias voltage may be be so as to have a plurality of kinds of values determined by the environmental conditions such as temperature and humidity of the location where the image data is installed.

Thereby, it is possible to always prevent the developer from remaining on the electrostatic latent image carrier even when the environmental conditions such as temperature and humidity of the location where the image data is installed change.

It is noted that although the case of using the one-component developer in the developing unit in the embodiment described above, the invention is not limited to that. It is possible to use two-component developer. Or the developer may be magnetic developer or non-magnetic developer even when the one-component developer is used.

The invention is constructed and is operative as described above and can provide a developing unit, and an image forming apparatus using the same, which is capable of suppressing developer in the middle of a developing process in a developing area from remaining on the surface of an electrostatic latent image carrier when the application of oscillatory bias voltage to be applied to the developer carrier is stopped and of preventing the inside of the image forming apparatus and each member such as transfer means from being contaminated by the developer, thus allowing a good image to be obtained with a simple circuit structure at low cost.

While the preferred embodiments have been described, variations thereto will occur to those skilled in the art within the scope of the present inventive concepts which are delineated by the following claims.

What is claimed is:

1. A developing unit for developing an electrostatic latent image formed on an electrostatic latent image carrier by disposing a developer carrier carrying developer so as to face said electrostatic latent image carrier and by applying an oscillatory bias voltage to said developer carrier, wherein said oscillatory bias voltage is stopped after increasing the frequency of said oscillatory bias voltage more than normal frequency.

2. The developing unit according to claim 1, wherein the increasing of the frequency is implemented stepwisely.

3. The developing unit according to claim 1, wherein the phase of an oscillatory component in stopping the application of said oscillatory bias voltage is located where a force is generated in the direction opposite from a force urging the developer to the electrostatic latent image carrier side in developing the electrostatic latent image.

4. The developing unit according to claim 3, wherein an output just before stopping the application of said oscillatory bias voltage has a voltage peak different from a normal voltage peak.

5. The developiog unit according to claim 1, wherein the phase of the oscillatory component when stopping the application of said oscillatory bias voltage is located where a force is generated in the direction opposite from a force urging the developer to the electrostatic latent image carrier side in developing the electrostatic latent image and an output just before stopping the application of said oscillatory bias voltage has a voltage peak different from a normal voltage peak.

6. An image forming apparatus for forming an image by forming an electrostatic latent image on an electrostatic latent image carrier corresponding to desired image data and by applying an oscillatory bias voltage to a developer carier which carrier developer and faces said electrostatic latent image carrier, wherein said oscillatory bias voltage is stopped after increasing the frequency of said oscillatory bias voltage more than a normal frequency.

7. An image forming apparatus for forming an image by forming an electrostatic latent image on an electrostatic latent image carrier corresponding to desired image data and by applying an oscillatory bias voltage to a developer carrier which carries developer and faces said electrostatic latent image carrier, wherein said oscillatory bias voltage is stopped after increasing the frequency of said oscillatory bias voltage stepwise more than a normal frequency.

8. The image forming apparatus according to claim 6, wherein a frequency which may interfere with a frequency of another AC component applied to an image forming section is avoided in increasing the frequency of said oscillatory bias voltage more than the normal frequency.

9. The image forming apparatus according to claim 6, wherein the frequency of said oscillatory bias voltage which is set higher than the normal frequency has a plurality of kinds of values determined by the environmental conditions such as temperature and humidity of the location where said image forming apparatus is installed.

10. A developing device for developing an electrostatic latent image formed on an electrostatic latent image carrier, the developing device comprising a developing unit and a bias control unit, the developiong unit having a developer carrier carrying developer so as to face the electrostatic latent image, the bias control unit applying a normal frequency of an oscillatory bias voltage to the developer carrier and also applying a relatively higher frequency of said oscillatory bias voltage to the developer carrier before the application of the oscillatory bias voltage is terminated.

* * * * *